US010010746B1

(12) United States Patent
Hsu

(10) Patent No.: US 10,010,746 B1
(45) Date of Patent: Jul. 3, 2018

(54) SEAT ADJUSTMENT STRUCTURE FOR EXERCISE MACHINE

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 0 days.

(21) Appl. No.: 15/388,255

(22) Filed: Dec. 22, 2016

(51) Int. Cl.
*A63B 21/00* (2006.01)
*A63B 22/00* (2006.01)
*A63B 22/06* (2006.01)

(52) U.S. Cl.
CPC ..... *A63B 22/0046* (2013.01); *A63B 21/4027* (2015.10); *A63B 22/0605* (2013.01); *A63B 2225/09* (2013.01)

(58) Field of Classification Search
CPC ..... A63B 21/00058; A63B 21/00069; A63B 21/00072; A63B 21/00076; A63B 21/002; A63B 21/0023; A63B 21/012; A63B 21/15; A63B 21/159; A63B 21/4027; A63B 21/4039; A63B 21/4045; A63B 21/4047; A63B 21/4049; A63B 22/0015; A63B 22/0017; A63B 22/0046; A63B 22/0048; A63B 22/0087; A63B 22/0089; A63B 22/06; A63B 22/0605; A63B 2022/0635; A63B 2022/0641; A63B 2022/0647; A63B 2022/0652; A63B 23/03516; A63B 23/04; A63B 23/0405; A63B 23/0476; A63B 23/0482; A63B 26/00; A63B 26/003; A63B 69/0057; A63B 69/0059; A63B 69/16; A63B 2069/0062; A63B 2069/166; A63B 2208/0228; A63B 2202/0233; A63B 2225/09; A63B 2225/093
See application file for complete search history.

(56) References Cited

U.S. PATENT DOCUMENTS 4,772,069 A * 9/1988 Szymski ..... B62J 1/08 297/214
4,958,831 A * 9/1990 Kim ..... G09B 9/058 434/61
5,007,675 A * 4/1991 Musto ..... B62J 1/08 297/215.14
5,423,728 A * 6/1995 Goldberg ..... A63B 22/0605 482/57

(Continued)

*Primary Examiner* — Joshua Lee
*Assistant Examiner* — Gary D Urbiel Goldner
(74) *Attorney, Agent, or Firm* — Rosenberg, Klein & Lee

(57) ABSTRACT

A seat adjustment structure for an exercise machine includes a T-shaped pipe, a sliding pipe, a locking member, and a connecting rod. The T-shaped pipe includes a transverse rod and an upright rod which are connected with each other. The transverse rod has an axial hole. The transverse rod has an elongated groove which is axially disposed along the transverse rod and extends to one of two ends of the transverse rod to form a notch. The sliding pipe slides from the notch into the transverse rod. The sliding pipe has a plurality of fixing holes. The locking member is disposed on the transverse rod and inserted in the axial hole, and can be engaged in any one of the fixing holes. Through the notch, the sliding pipe can be transversely inserted into the axial hole and accommodated in the transverse rod. The assembly operation is easy and simple.

4 Claims, 9 Drawing Sheets

(56) References Cited

U.S. PATENT DOCUMENTS 5,441,327 A * 8/1995 Sanderson ..... B62J 1/04 297/195.1
6,491,606 B1 * 12/2002 Swift ..... A63B 22/0605 482/57
6,669,603 B1 * 12/2003 Forcillo ..... A63B 21/015 482/51
6,752,453 B1 * 6/2004 Yapp ..... B62J 1/08 248/298.1
6,881,178 B1 * 4/2005 Goldberg ..... A63F 3/06 482/57
7,004,888 B1 * 2/2006 Weng ..... A63B 21/0051 482/57
7,081,070 B1 * 7/2006 Washington ..... A63B 22/0605 434/61
7,494,181 B2 * 2/2009 Tucker ..... B62J 1/005 248/298.1
7,951,048 B1 * 5/2011 Hsiung ..... A63B 22/001 482/52
8,668,261 B2 * 3/2014 Schranz ..... B62K 19/36 297/195.1
9,480,877 B2 * 11/2016 Chiang ..... A63B 22/0605
9,610,473 B2 * 4/2017 Chiang ..... A63B 22/0605
9,616,281 B2 * 4/2017 Hsiung ..... A63B 22/0664
9,663,167 B2 * 5/2017 Fagnan ..... B62J 1/08
9,671,062 B2 * 6/2017 Speronati Laghi .... F16M 13/02
9,724,589 B2 * 8/2017 Baudhuin ..... A63B 71/0622
2001/0031686 A1 * 10/2001 Ware ..... A63B 21/015 482/57
2002/0151414 A1 * 10/2002 Baker ..... A63B 22/0605 482/57
2002/0168792 A1 * 11/2002 Goldberg ..... A63B 22/0605 438/57
2003/0008754 A1 * 1/2003 Fon ..... A63B 22/00 482/57
2003/0092534 A1 * 5/2003 Forcillo ..... A63B 21/015 482/57
2004/0079184 A1 * 4/2004 Luetkemueller ..... B62K 21/16 74/491
2005/0221961 A1 * 10/2005 Forcillo ..... A63B 21/225 482/57
2006/0003870 A1 * 1/2006 Corbalis ..... A63B 22/0605 482/57
2006/0079382 A1 * 4/2006 Lassanske ..... A63B 21/22 482/63
2006/0189439 A1 * 8/2006 Baudhuin ..... A63B 24/00 482/8
2006/0234836 A1 * 10/2006 Kuo ..... A63B 22/0605 482/57
2006/0234840 A1 * 10/2006 Watson ..... A63B 24/00 482/61
2008/0058170 A1 * 3/2008 Giannascoli ..... A63B 69/16 482/57
2008/0096725 A1 * 4/2008 Keiser ..... A63B 21/0051 482/8
2009/0023559 A1 * 1/2009 Bingham, Jr. ..... A63B 22/00 482/57
2009/0048076 A1 * 2/2009 Irving ..... A63B 21/015 482/57
2009/0156371 A1 * 6/2009 Goldberg ..... A63B 21/225 482/62
2009/0170667 A1 * 7/2009 Irving ..... A63B 21/225 482/57
2009/0227429 A1 * 9/2009 Baudhuin ..... A63B 71/0622 482/57
2010/0009815 A1 * 1/2010 Chen ..... A63B 21/00069 482/63
2010/0041523 A1 * 2/2010 Bingham, Jr. ..... A63B 21/225 482/65
2010/0080650 A1 * 4/2010 Gorza ..... B62J 1/08 403/374.5
2010/0234185 A1 * 9/2010 Watt ..... A63B 21/0051 482/8
2010/0289246 A1 * 11/2010 Williams ..... A63B 22/0605 280/281.1
2011/0152040 A1 * 6/2011 van der Meer .. A63B 21/00196 482/57
2011/0185803 A1 * 8/2011 Demajistre ..... B62J 99/00 73/147
2011/0237397 A1 * 9/2011 Mabey ..... A63B 22/0605 482/4
2012/0088638 A1 * 4/2012 Lull ..... A63B 21/015 482/57
2012/0161480 A1 * 6/2012 Lu ..... B62J 1/08 297/215.14
2013/0065733 A1 * 3/2013 Kautz ..... A63B 69/16 482/57
2013/0072356 A1 * 3/2013 Machida ..... A63B 21/00076 482/58
2014/0038781 A1 * 2/2014 Foley ..... A63B 24/0075 482/9
2014/0221158 A1 * 8/2014 Mabey ..... A63B 24/0087 482/4
2015/0045190 A1 * 2/2015 Keiser ..... A63B 21/0051 482/57
2015/0054319 A1 * 2/2015 Kim ..... B62K 19/36 297/215.14
2015/0080195 A1 * 3/2015 Yeh ..... A63B 21/012 482/114
2015/0119203 A1 * 4/2015 Kautz ..... A63B 69/16 482/57
2015/0174446 A1 * 6/2015 Chiang ..... A63B 22/0605 482/8
2016/0076694 A1 * 3/2016 Speronati Laghi .... F16M 13/02 248/274.1
2016/0263416 A1 * 9/2016 Golesh ..... A63B 21/0051
2016/0263417 A1 * 9/2016 Golesh ..... A63B 21/00069
2016/0317860 A1 * 11/2016 Baudhuin ..... A63B 22/0605

* cited by examiner

SEAT ADJUSTMENT STRUCTURE FOR EXERCISE MACHINE

FIELD OF THE INVENTION

The present invention relates to a seat adjustment structure for an exercise machine, and more particularly to a transverse rod of a T-shaped pipe being provided with an elongated groove which is axially disposed along the transverse rod and extends to one of two ends of the transverse rod to form a notch for a sliding pipe connected with a seat to slide into an axial hole from the notch so that the seat can be adjusted forward or rearward along the transverse rod.

BACKGROUND OF THE INVENTION

Taiwanese Utility Model Patent No. M466684 discloses a fixing structure for an exercise bicycle seat, which comprises a T-shaped pipe, a sliding pipe, an axial quick-release member, a pivot member, and a connecting rod. The T-shaped pipe includes a transverse rod and an upright rod which are connected with each other. The transverse rod has an axial hole in the axial direction, and an elongated groove and a locking hole corresponding to the quick-release member in the radial direction. For the sliding pipe to be movably accommodated in the transverse rod, the sliding pipe is formed with a receiving hole. The axial quick-release member is disposed in the locking hole to selectively limit the movement of the sliding pipe. The pivot member is fixed to the sliding pipe, and has an accommodation hole corresponding in position to the receiving hole. One end of the connecting rod is inserted in the accommodation hole, and the other end of the connecting rod is inserted in the receiving hole and the elongated groove. By means of the assembly of the above-mentioned structure, the upright rod is connected with the frame of the exercise bicycle and can be adjusted for a desired height. The connecting rod is connected with the seat, such that the seat can be adjusted forward or rearward through the sliding pipe. In this way, the seat will not be accidentally separated, and the operation space of the exercise bicycle won't be interfered, and the appearance of the exercise bicycle is pleasing to the eye.

The exercise bicycle seat of the aforesaid structure can be adjusted by the user, but the connecting rod of the sliding pipe must be first dismounted for the sliding pipe to be inserted into the transverse rod when assembled. After that, the receiving hole of the sliding pipe must be aligned with the elongated groove for the connecting rod to be installed in the receiving hole of the sliding pipe through the elongated groove. The procedure is complicated and the assembly operation is troublesome, so the assembly time is increased and the manufacturing cost is high, not meeting the requirements of economic benefits.

Accordingly, the inventor of the present invention has devoted himself based on his many years of practical experiences to solve these problems.

SUMMARY OF THE INVENTION

The primary object of the present invention is to provide a seat adjustment structure for an exercise machine. The adjustment structure includes a T-shaped pipe, a sliding pipe, a locking member, and a connecting rod. The T-shaped pipe includes a transverse rod and an upright rod which are connected with each other. The transverse rod has two ends and an axial hole extending axially through the two ends. The transverse rod is provided with an elongated groove.

The elongated groove communicates with the axial hole and is axially disposed along the transverse rod and extends to at least one of the two ends to form a notch at the end. The sliding pipe is configured to be slid from the notch into the axial hole and is accommodated in the transverse rod. The sliding pipe is provided with a plurality of fixing holes. The locking member is disposed on the transverse rod and is inserted in the axial hole. The locking member is configured to be engaged in any one of the fixing holes of the sliding pipe. An end of the connecting rod is connected to the sliding pipe, and another end of the connecting rod extends out of the elongated groove.

Preferably, the axial hole is plugged with a guide member. The guide member has a guide perforation defined axially in the guide member for insertion of the sliding pipe, such that the sliding pipe can slide along the guide perforation.

Preferably, the transverse rod is provided with a locking pipe extending from one side of the transverse rod. The locking pipe has an annular retaining wall therein. The locking member includes a retaining lever and a stopper. The retaining lever is inserted through the locking pipe into the axial hole to be engaged in one of the fixing holes of the sliding pipe. The retaining lever is connected with a knob. The knob extends out of the locking pipe. The stopper is located in the locking pipe and stopped by the retaining wall. The retaining lever is screwed to the stopper. By pressing the knob, an end of the stopper is pressed against the sliding pipe and then the knob is rotated relative to the stopper. The retaining lever is partially disengaged from the stopper, such that the retaining lever is moved out of the fixing holes, enabling the sliding pipe to be displaced.

Preferably, the sliding pipe is a polygonal pipe. The end of the stopper is formed with a recess corresponding to the polygonal pipe. When the end of the stopper is pressed against the sliding pipe, the recess of the stopper is engaged with the sliding pipe, such that the knob can be rotated relative to the stopper and the retaining lever is partially unscrewed from the stopper to be displaced.

Preferably, the stopper is annularly provided with a first stop wall. The guide member has a second stop wall. The stopper is fitted with an elastic member. When the knob is pressed, the elastic member is held between the first stop wall and the second stop wall to store an elastic force. When the knob is released, the elastic member releases the elastic force to bring the stopper back.

According to the foregoing technical features, the present invention can achieve the following effects:

Through the notch, the sliding pipe connected with the connecting rod and the seat can be transversely inserted into the axial hole and accommodated in the transverse rod. The assembly operation is easy and simple so as to reduce the assembly time and to lower the manufacturing cost.

Through the guide perforation of the guide member, the sliding pipe can be moved stably and precisely, and the seat won't be shaken easily to cause a skew when it is fixed.

Furthermore, the seat can be adjusted forward or rearward as desired according to the needs of the user. It is necessary to simultaneously press and rotate the knob for the adjustment of the seat, so it is more reliable and safer for use. This structure can prevent any accidental movement disengagement of the seat.

DESCRIPTION OF THE PREFERRED EMBODIMENTS

Embodiments of the present invention will now be described, by way of example only, with reference to the accompanying drawings.

Figure 1:
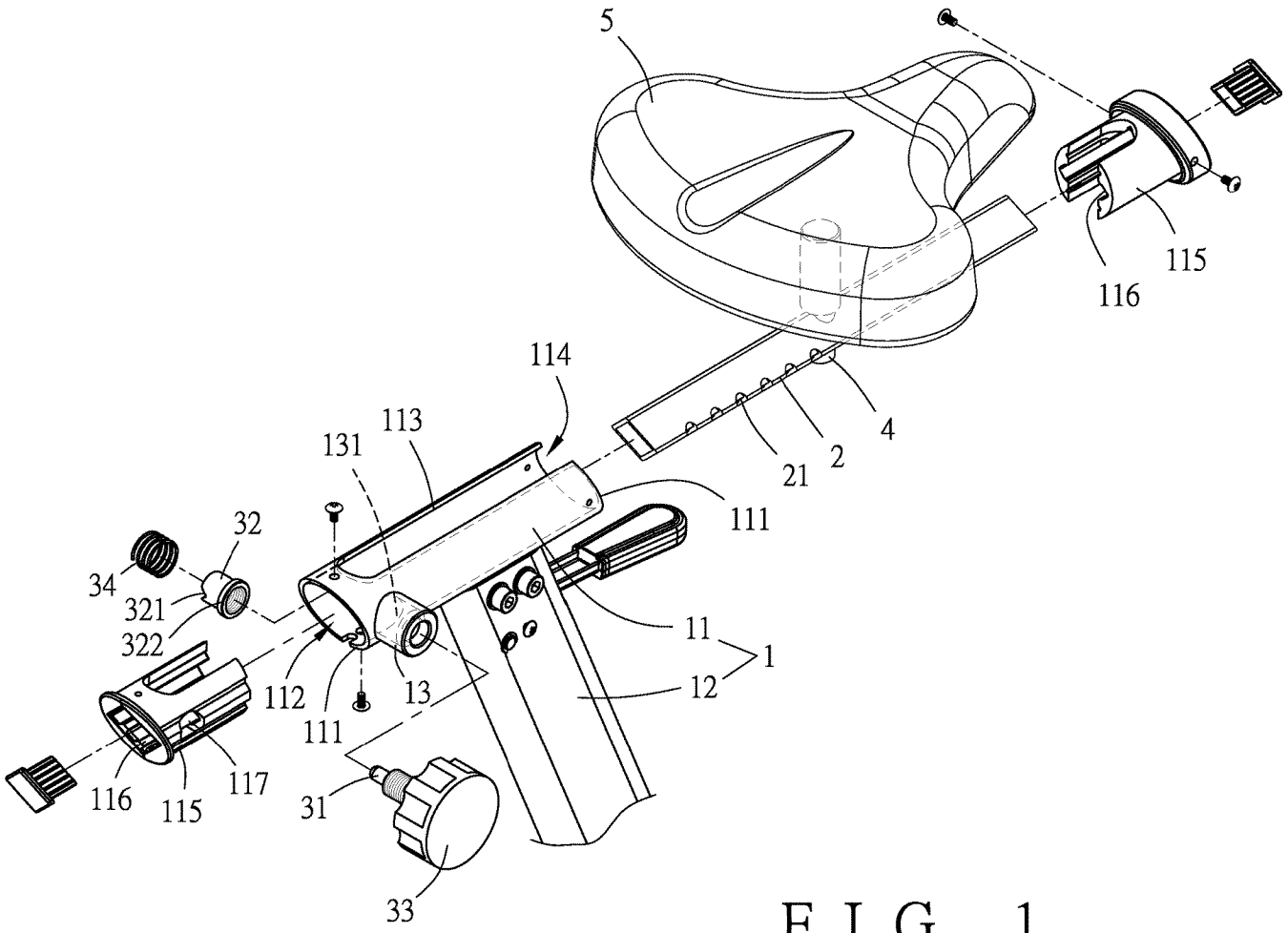
FIG. 1 is an exploded view in accordance with an embodiment of the present invention.
Figure 2:
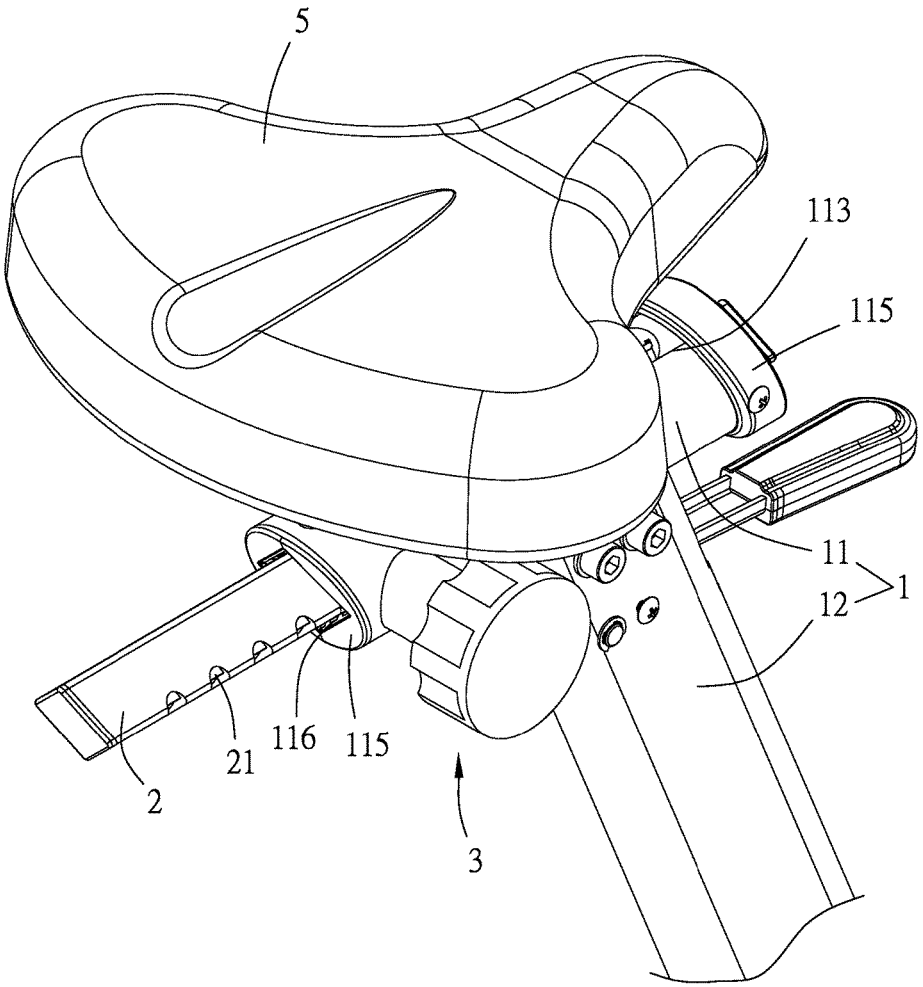
FIG. 2 is a perspective view in accordance with the embodiment of the present invention.

As shown in FIG. 1 and FIG. 2, a seat adjustment structure for an exercise machine according to a preferred embodiment of the present invention includes a T-shaped pipe 1, a sliding pipe 2, a locking member 3, and a connecting rod 4.

The T-shaped pipe 1 includes a transverse rod 11 and an upright rod 12 which are connected with each other. The upright rod 12 is further connected with a frame of an exercise bicycle. The transverse rod 11 has two ends 111. The transverse rod 11 has an axial hole 112 extending axially through the two ends 111. The transverse rod 11 is provided with an elongated groove 113 communicating with the axial hole 112. The elongated groove 113 is axially disposed along the transverse rod 11 and extends to one of the two ends 111 to form a notch 114 on the transverse rod 11. The two ends 111 of the transverse rod 11 are each plugged with a guide member 115. At least one of the guide members 115 has a guide perforation 116 defined axially in the guide member 115. In this embodiment, the guide perforation 116 has a right-angled edge. The transverse rod 11 is provided with a locking pipe 13 extending from one of the transverse rod 11. The locking pipe 13 has an annular retaining wall 131 therein. The guide member 115 which is closer to the locking pipe 13 is provided with a locking hole 117. The locking hole 117 corresponds to the locking pipe 13.

The sliding pipe 2 is configured to be slid from the notch 114 into the axial hole 112 and thus be accommodated in the transverse rod 11. Furthermore, the sliding pipe 2 is inserted into the guide perforation 116 and is provided with a plurality of fixing holes 21. The sliding pipe 2 is a polygonal pipe. In this embodiment, the polygonal pipe is a quadrangular pipe. The quadrangular pipe is inserted into the guide perforation 116 having the right-angled edge to limit the degree of freedom of the sliding pipe 2, so that the sliding pipe 2 can only slide axially.

Figure 3:
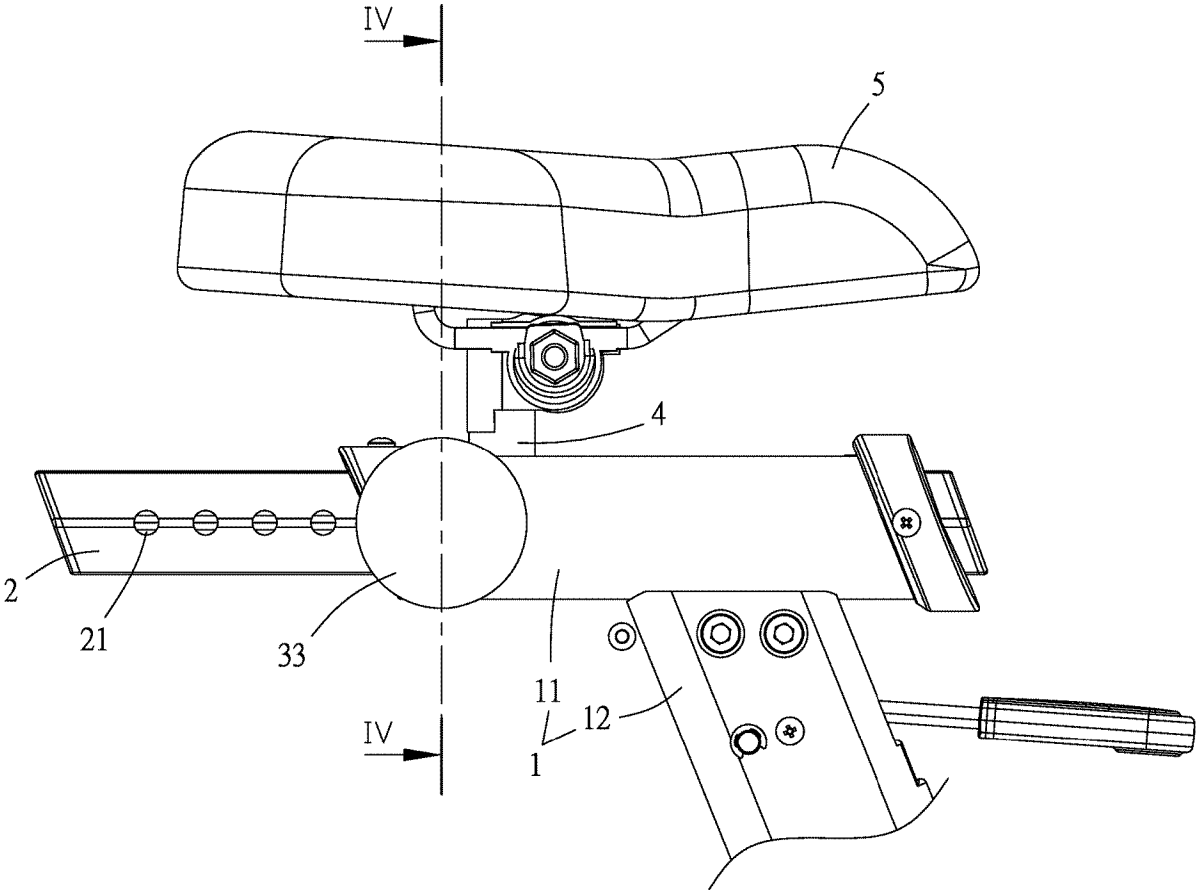
FIG. 3 is a lateral view in accordance with the preferred embodiment of the present invention.
Figure 3A:
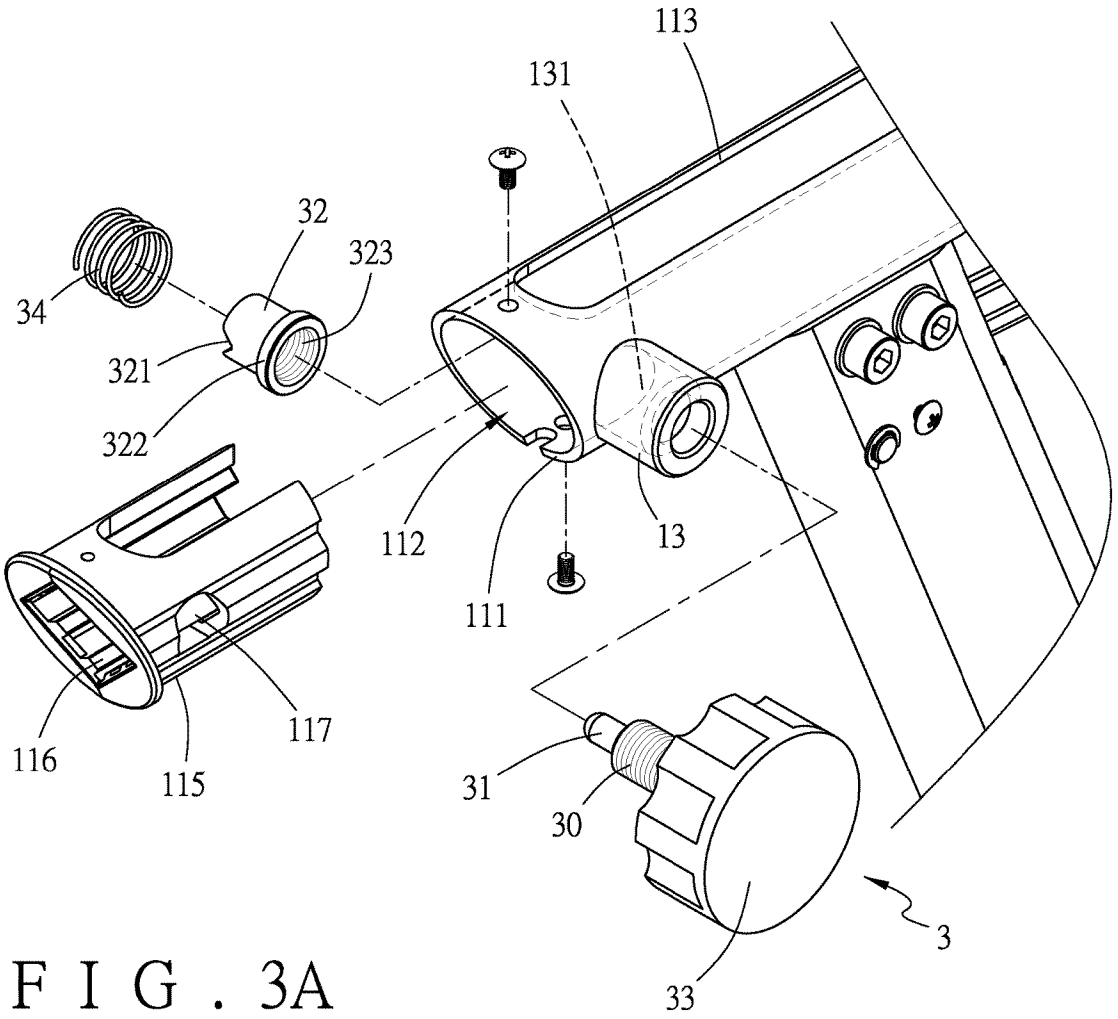
FIG. 3A is a partially exploded view showing the locking member in accordance with the preferred embodiment of the present invention.
Figure 4:
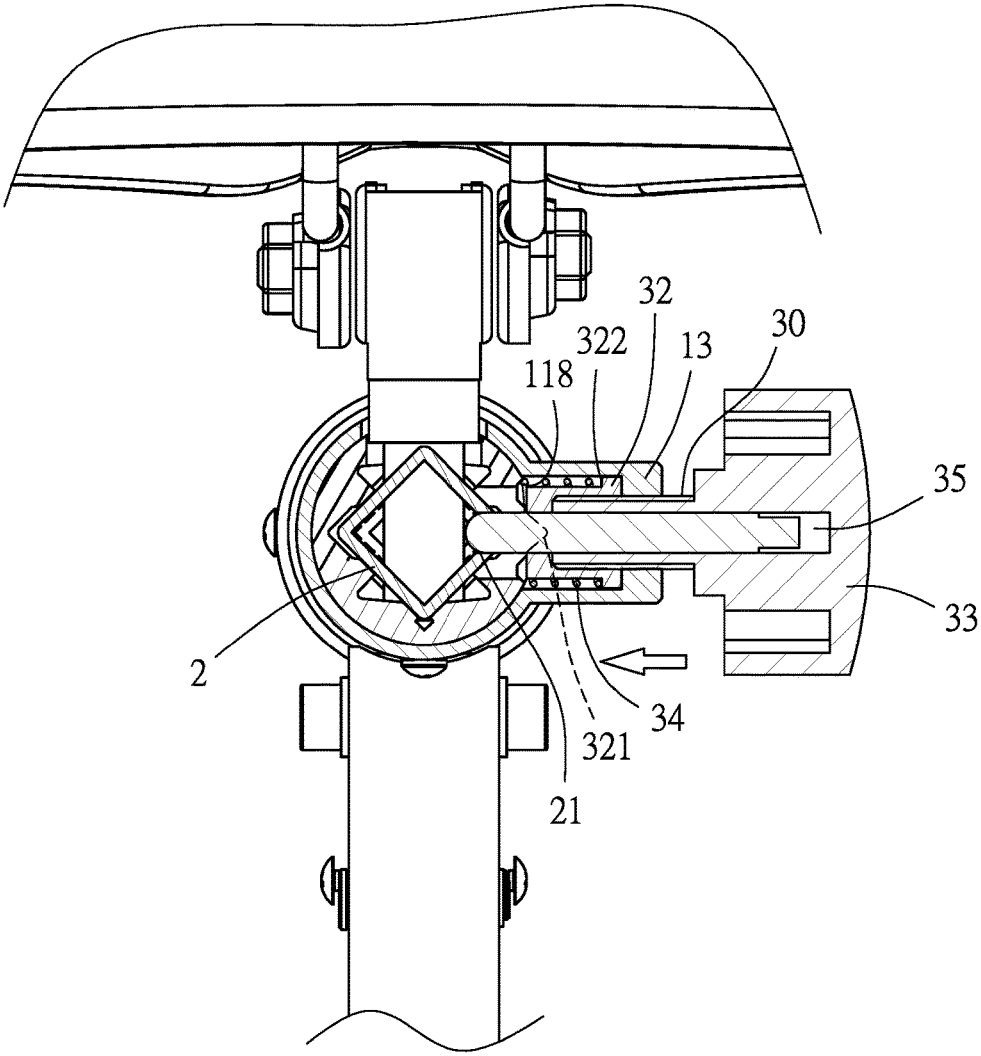
FIG. 4 is a cross-sectional view taken along line IV-IV in FIG. 3, schematically showing how the locking member is operated in accordance with the preferred embodiment of the present invention.

Referring to FIG. 3, FIG. 3A, and FIG. 4, the locking member 3 is disposed on the transverse rod 11. The locking member 3 includes an outer threaded section 30, a retaining lever 31, and a stopper 32. The outer threaded section 30 is provided with a knob 33 extending therefrom. A coupling hole 35 is defined in the outer threaded section 30 and extends to the knob 33. An end of the retaining lever 31 is coupled to the coupling hole 35. The stopper 32 has an inner threaded section 323 therein. The inner threaded section 323 is configured to be screwed to the outer threaded section 30. Another end of the retaining lever 31 is inserted through the locking pipe 13 into the axial hole 112 and can be engaged in any one of the fixing holes 21 of the sliding pipe 2. The knob 33 extends out of the locking pipe 13. The stopper 32 is located in the locking pipe 13 and stopped by the retaining wall 131. An end of the stopper 32 is formed with a recess 321 corresponding to the quadrilateral pipe. The stopper 32 is annularly provided with a first stop wall 322. Furthermore, the guide member 115 closer to the locking pipe 13 has a second stop wall 118. The stopper 32 is fitted with an elastic member 34. The elastic member 34 is held between the first stop wall 322 and the second stop wall 118. In this embodiment, the elastic member 34 is a spring.

An end of the connecting rod 4 is connected to the sliding pipe 2. Another end of the connecting rod 4 extends out of the elongated groove 113 and is connected with a seat 5.

Figure 5:
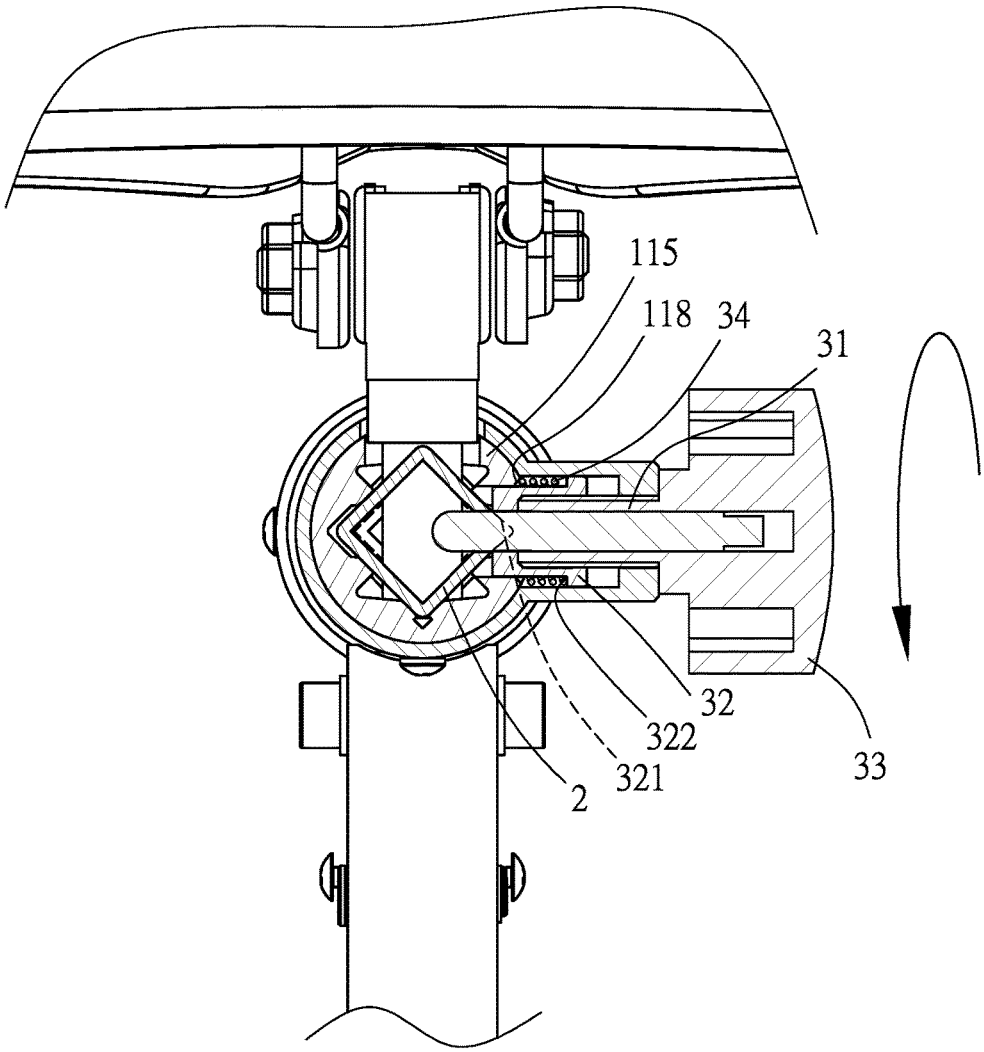
FIG. 5 is another cross-sectional view taken along line IV-IV in FIG. 3, schematically showing how the locking member is operated in accordance with the preferred embodiment of the present invention.
Figure 6:
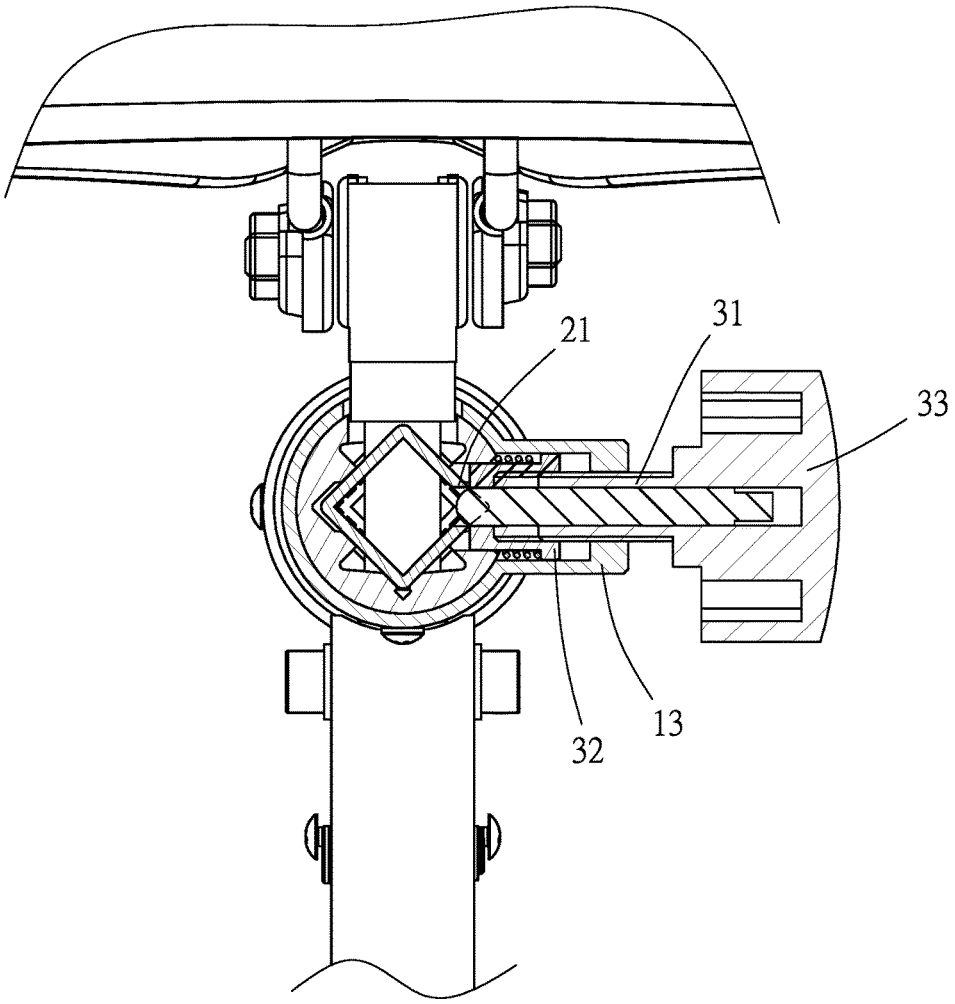
FIG. 6 is still another cross-sectional view taken along line IV-IV in FIG. 3, schematically showing how the locking member is operated in accordance with the preferred embodiment of the present invention.
Figure 7:
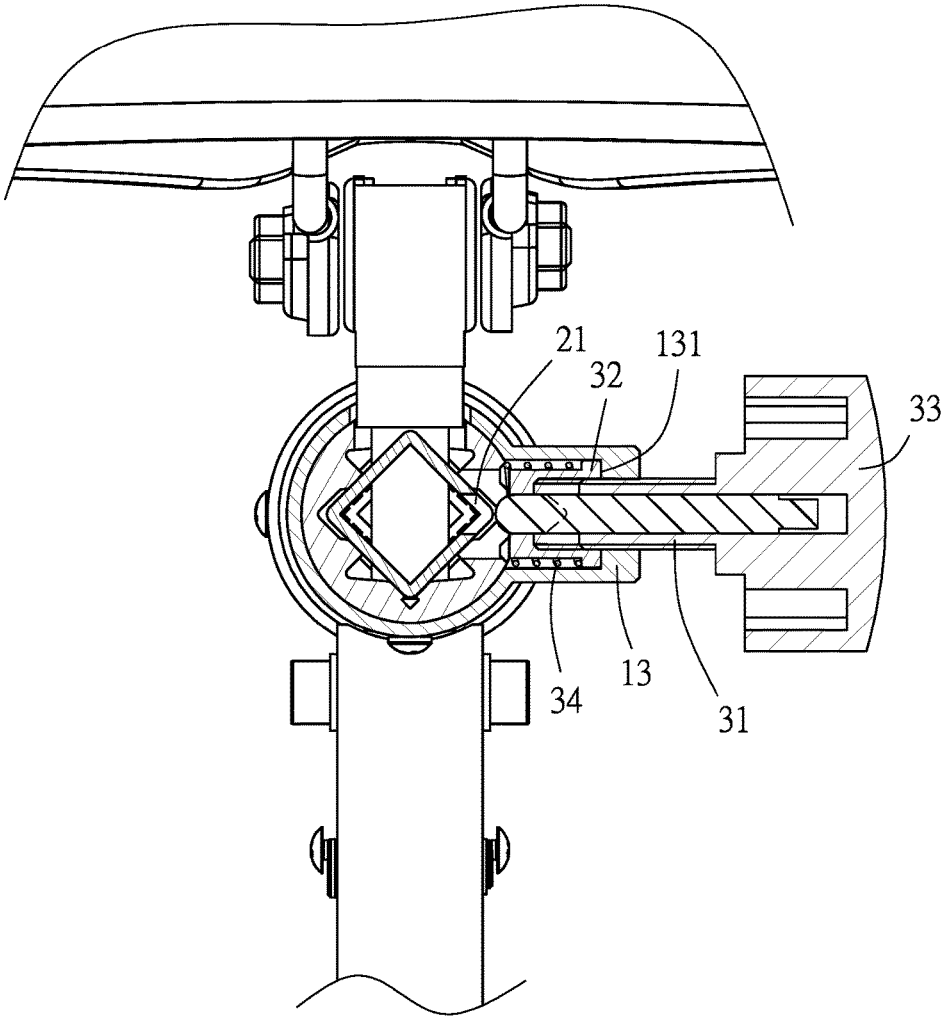
FIG. 7 is yet another cross-sectional view taken along line IV-IV in FIG. 3, schematically showing how the locking member is operated in accordance with the preferred embodiment of the present invention.

Referring again to FIGS. 1, 3 and 4, when it is desired to adjust the seat 5 forward or rearward, the knob 33 is first pressed, enabling the stopper 32 to be pressed against the sliding pipe 2. Referring to FIG. 5, when the stopper 32 is pressed against the sliding pipe 2, the recess 321 of the stopper 32 is to engage with and hold against the sliding pipe 2. Meanwhile, the elastic member 34 is compressed to store an elastic force. The knob 33 is then rotated (in this embodiment, it is rotated counterclockwise). At this time, because the recess 321 of the stopper 32 is engaged with the sliding pipe 2, the stopper 32 cannot be turned. Thus, the rotation of the knob 33 enables the retaining lever 31 to generate a rotary displacement relative to the stopper 32. As shown in FIG. 3A and FIG. 6, when the inner threaded section 323 is unscrewed from the outer threaded section 30, the retaining lever 31 is partially disengaged from the stopper 32 and the locking pipe 13, so that the distal end of the retaining lever 31 can be moved out of the fixing hole 21. As shown in FIG. 7, when the retaining lever 31 is partially disengaged from the stopper 32 and the distal end of the retaining lever 31 is moved out of the fixing hole 21, the pressing operation of the knob 33 is stopped, allowing the elastic element 34 to release its elastic force, so that the stopper 32 biased by the elastic member 34 returns to the initial position to be stopped by the retaining wall 131.

Figure 8:
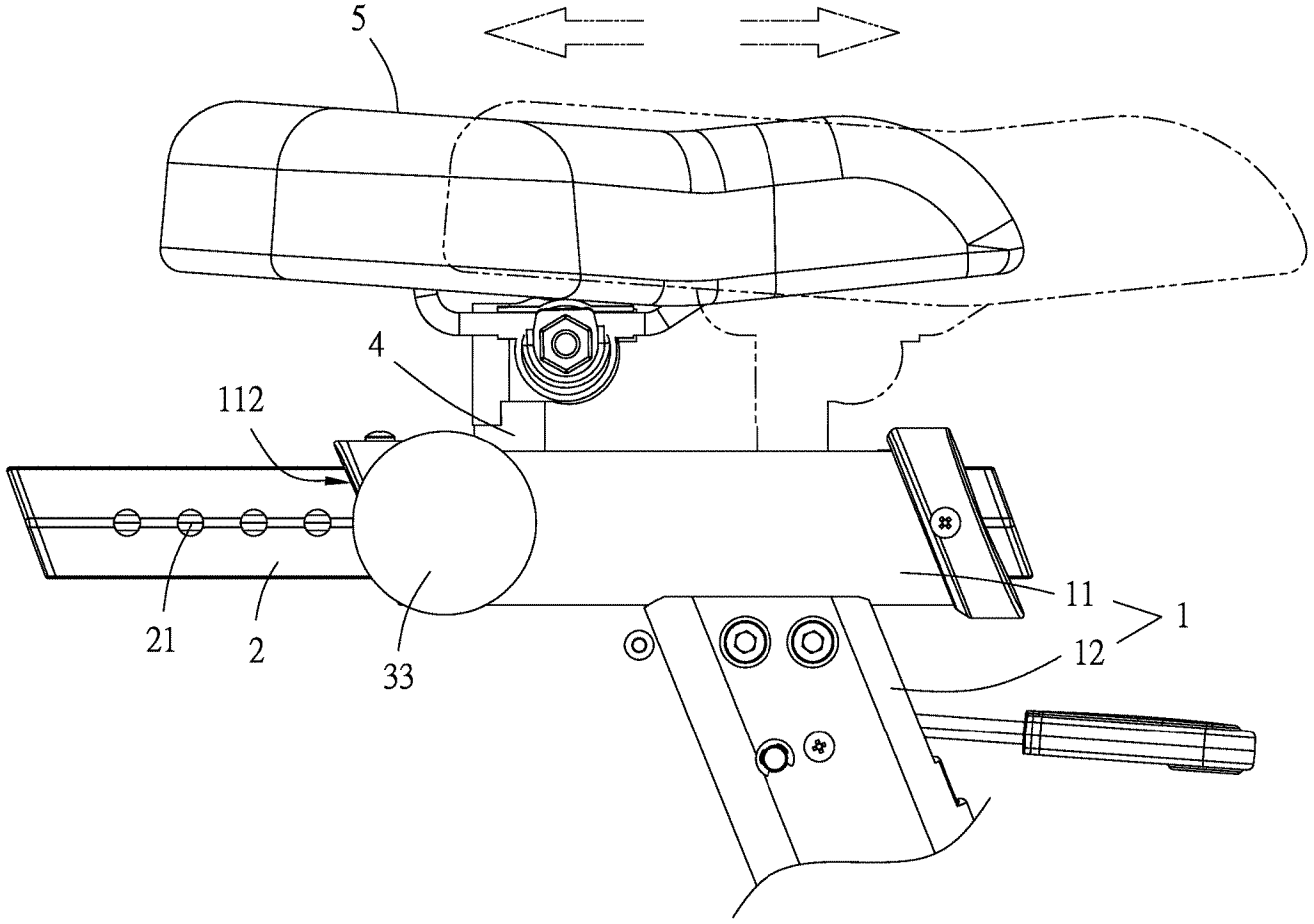
FIG. 8 is a schematic view showing the seat to be adjusted forward or rearward in accordance with the preferred embodiment of the present invention when in use.

Referring to FIG. 8, after the retaining lever 31 is moved out of the fixing hole 21, the seat 5 can be adjusted forward or rearward as desired according to the user's needs. When adjusted, the seat 5 is applied with a force to link the connecting rod 4 and the sliding pipe 2, so that the sliding pipe 2 can be moved along the axial hole 112 of the transverse rod 11 to adjust the position of the seat 5 as desired. Afterward, the knob 33 is pressed again and rotated clockwise for the retaining lever 31 to be partially screwed to the stopper 32, and the distal end of the retaining lever 31 is inserted in the corresponding the fixing hole 21 to limit the displacement (not shown in the drawing) of the sliding pipe 2. That is to say, the seat 5 can be quickly adjusted forward or rearward. As shown in FIG. 4 to FIG. 7, it is necessary to simultaneously press and rotate the knob 33 for adjusting the position of the seat 5, so it is safe and durable for use, preventing any accidental movement of the seat 5 or disengagement from the T-shaped pipe 1.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A seat adjustment structure for an exercise machine, the seat adjustment structure comprising:

a T-shaped pipe, including a transverse rod and an upright rod which are connected with each other, the transverse rod having two ends, the transverse rod having an axial hole extending axially through the two ends, the transverse rod being provided with an elongated groove, the elongated groove communicating with the axial hole, the elongated groove being axially disposed along the transverse rod and extending to one of the two ends to form a notch at the one end;

a sliding pipe, configured to be slid from the notch into the axial hole and accommodated in the transverse rod, the sliding pipe being provided with a plurality of fixing holes;

a locking member, disposed on the transverse rod, the locking member being inserted in the axial hole and configured to be engaged in any one of the plurality of fixing holes of the sliding pipe; and a connecting rod, an end of the connecting rod being connected to the sliding pipe, another end of the connecting rod extending out of the elongated groove;

wherein the transverse rod is provided with a locking pipe extending from one side of the transverse rod, the locking pipe having an annular retaining wall therein; the locking member includes a retaining lever and a stopper, wherein the retaining lever is inserted through the locking pipe into the axial hole to be engaged in one of the plurality of fixing holes of the sliding pipe; the retaining lever is screwed to the stopper and further connected with a knob, the knob extending out of the locking pipe; the stopper is located in the locking pipe and stopped by the retaining wall; and by pressing the knob, an end of the stopper is pressed against the sliding pipe and then the knob is rotated relative to the stopper, the retaining lever is partially disengaged from the stopper, such that the retaining lever is moved out of the one of the plurality of fixing holes, enabling the sliding pipe to be displaced.

2. The seat adjustment structure as claimed in claim 1, wherein the axial hole is plugged with a guide member, the guide member has a guide perforation defined axially in the guide member for insertion of the sliding pipe, such that the sliding pipe can slide along the guide perforation.

3. The seat adjustment structure as claimed in claim 2, wherein the sliding pipe is a polygonal pipe, the end of the stopper is formed with a recess corresponding to the polygonal pipe, when the end of the stopper is pressed against the sliding pipe, the recess of the stopper is engaged with the sliding pipe, such that the knob can be rotated relative to the stopper, and the retaining lever is partially unscrewed from the stopper to be displaced.

4. The seat adjustment structure as claimed in claim 2, wherein the stopper is annularly provided with a first stop wall, the guide member has a second stop wall, and the stopper is fitted with an elastic member; when the knob is pressed, the elastic member is held between the first stop wall and the second stop wall to store an elastic force; when the knob is released, the elastic member releases the elastic force to bring the stopper back.

* * * * *